US009241856B2

(12) United States Patent
Summers

(10) Patent No.: US 9,241,856 B2
(45) Date of Patent: Jan. 26, 2016

(54) PATIENT POSITIONING SYSTEM

(71) Applicant: Timothy J. Summers, Encinitas, CA (US)

(72) Inventor: Timothy J. Summers, Encinitas, CA (US)

( * ) Notice: Subject to any disclaimer, the term of this patent is extended or adjusted under 35 U.S.C. 154(b) by 0 days.

(21) Appl. No.: 14/589,880

(22) Filed: Jan. 5, 2015

(65) Prior Publication Data

US 2015/0135434 A1 May 21, 2015

Related U.S. Application Data

(63) Continuation of application No. 13/287,075, filed on Nov. 1, 2011, now Pat. No. 8,925,126.

(60) Provisional application No. 61/408,953, filed on Nov. 1, 2010.

(51) Int. Cl.

| | |
|---|---|
| ***A61G 7/10*** | (2006.01) |
| ***A61G 7/00*** | (2006.01) |
| ***A61G 7/057*** | (2006.01) |
| ***A61G 7/07*** | (2006.01) |

(52) U.S. Cl.
CPC ..... *A61G 7/001* (2013.01); *A61G 7/057* (2013.01); *A61G 7/07* (2013.01)

(58) Field of Classification Search
CPC ..... A61G 7/10
USPC ..... 5/81.1 R, 81.1 T, 81.1 HS, 88.1
See application file for complete search history.

(56) References Cited

U.S. PATENT DOCUMENTS 4,361,918 A * 12/1982 Roisaeth ..... 5/81.1 T

* cited by examiner

*Primary Examiner* — Fredrick Conley
(74) *Attorney, Agent, or Firm* — Donn K. Harms

(57) ABSTRACT

A patient support device for supporting maintaining a patient laying on the side of their body in bed, for a duration of time for medical personnel to attend to the patient or change the linen on the bed. The support device features a patient support member which extends between the bed surface and a distal upper edge. The patient's weight is supported by a central area of the support member and the force of the weight is communicated to a hand rail or bed component by a member extending from the upper edge.

10 Claims, 9 Drawing Sheets

PATIENT POSITIONING SYSTEM

This application is a Continuation in Part application to U.S. patent application Ser. No. 13/287,075 filed on Nov. 1, 2011 which claims the benefit of U.S. Provisional Application No. 61/408,953, filed Nov. 1, 2010, and which are hereby incorporated by reference in their respective entirety herein.

BACKGROUND OF THE INVENTION

1. Field of the Invention

The present invention relates to devices for maintaining a positioning of a patient on a hospital bed or bed of the like. More particularly, it relates to a device providing a means for a single medical attendant to securely, temporarily position a patient on their side thereby allowing for patient care, involving patient positioning, by a single person where generally more than one caretaker may be required.

2. Prior Art

Conventionally, when a hospital patient is confined to their bed for reasons of reduced body strength, stroke, paralysis, or the like, it is extremely important to move the patient frequently to help avoid pressure sores. Movement of the patient is also involved for in-bed bathing and other patient care needs as well as to maintain the bed itself as a clean environment.

As an example, in order to change sheets and to maintain the bed and resultant patient hygiene, a medical caretaker must have access to the mattress fitting sheet covered by the patient's entire body. With a patient unable to move himself, the medical staff must be able to move the patient from their position on the bedding, to allow a linen change. As also noted, for personal hygiene purposes, a patient who is paralyzed or movement-impaired generally must be rolled from a position where they are laying on their back to one where they are laying on one side. This rolled positioning is easier on the patient and positions the patient on one side edge of the bed within easy reach to allow the medical caregiver access for bathing, cleaning, and changing of dressings and the like.

In order to change bedding, generally the patient must be rolled to one side of the bed and held there for a duration of time necessary to remove and replace the sheet on the opposite half of the mattress. Once that task is finished, the patient is then rolled back to the other side of the bed which was just changed, and there they must be held on their other side to allow the finishing of the linen change. This rolling type patient moving procedure is followed as it minimizes the potential for patient injury which can occur with a lift. Generally, it is employed in most medical facilities by the staff in order to accomplish the aforementioned tasks of linen changes and patient treatment.

During the task of moving the patient, as a patient is rolled onto their side, they are naturally unbalanced as the width of their body is balanced on the small side surface. Further, if the patient has suffered a paralyzing injury, the patient is of no help, and great care must be taken to make sure their limbs follow their torso during a roll procedure to prevent injuries. However, when placed on the bed resting on the side of their body, the patient's body naturally starts to roll toward the more stable position onto their backs. Because such patients are usually unable to provide much assistance to the caregiver, it makes the positioning process quite strenuous and multi-tasked. Consequently, as a general rule, multiple caregivers or nurses are required to both roll and to maintain the patient in the unstable side position. Having two valuable medical personnel working on one patient for such a duration of time is an expensive and time-consuming act using valuable medical personnel. Many attempts in prior art are seen to combat this problem but fall short in many aspects.

U.S. Pat. No. 5,359,739 to Rains et al., U.S. Pat. No. 6,393,636 to Wheeler, and Pub. No. US 2005/0155149 A1 to Pedersen all teach different methods and devices for patient repositioning or rotating. However, while all patents providing a mechanical or structural support system that achieves the goal of temporarily positioning a patient on their side, they do so in a manner that would obstruct the process of changing sheets or accomplishing other tasks that require a partially cleared mattress top. This is either because the device itself sits on the mattress top or the device moves the mattress along with the patient.

As such, there is a continuing and unmet need for a device and method which provides for the convenient and safe movement of a patient to their side. Such a device should maintain the patient securely on their side while medical personnel go about their business. Additionally, such a system should be compact and lightweight rendering it easy to store, transport, and to employ. Such a device and system should provide for comfortable and secure patient positioning on their sides for the durations necessary for linen changes and for hygiene and the like. Still further, and particularly preferred to minimize the use of highly skilled medical personnel, such a system should be easily employed by a single care giver, thereby reducing the duplication of effort by multiple caregivers and thereby freeing them up to care for other patients.

SUMMARY OF THE INVENTION

The device and method herein disclosed and described provides an easily employed means to achieve the above noted goals through the provision of a patient support and securing means. The device employs a lightweight substantially rigid support member which is easily transported by a caregiver, as a means for supporting and maintaining a patient positioned on their side, in that position for a duration of time necessary for linen changes and medial procures. By substantially rigid is meant that the member maintains an elongated planar shape whether in an as-used position engaged with a patient, or when removed and may flex but will return unaided to the planar configuration adapted to contact the back of the patient. Substantially rigid can include elastic or plastic materials such as foam or hollow or solid polymeric materials as well as metal or wood materials.

In the as-used position of a preferred mode of the device, the back of the patient rests and is supported on the substantially rigid support member formed in a unitary structure which is rigid or flexible but biased to return to a planar shape, or formed of a plurality of padded members instead elongated member, if such is desired. The support component is easily engaged to the opposite side of the bed of the caretaker using a means to maintain the support component in an inclined position supporting the patient on their side. This means to maintain the support component substantially vertical is provided in current favored modes of the device by an engagement member such as a flexible strap or lightweight adjustable member in operative engagement with the support component at a first end and having means to engage the distal end to the bed or bed rail. Currently, this means to engage the bed or bed rail is provided by one of a hook or compression clip. The hook or compression exerting clip in operation maintains an engagement to the bed or bed rail at the distal end of the member or strap.

As noted, the patient is maintained at a position on their side by the operatively positioned support against their back, in the as-used position supported by the elongated member, by an engagement member which currently may be from a group of such members including a flexible length-adjustable strap or a length-adjustable substantially rigid member. The engagement member is connected at a distal end with a means for temporary engagement with the bed rail or bed such as a hook or clamp or the like.

While an open hooked member will work, currently, the engagement members favored are a hooked member, a biased pair of overlapping hooked members, or a compressing clip. The compressing clip can be biased to open then close or may be operable with one hand to close two jaw portions of the clip, such that the clip is securely mounted to surround or compress upon a member forming the bed rail or a portion of the bed frame, and therefore cannot dismount absent the medical professional activating a release. In a biased mode two halves of the clip would overlap by default and can be spread to engage the rail whereafter they will close. The hook engagement while similar to engage is also simpler to disengage and would not be preferable with patients who might be injured by a sudden release or those that move about when supported.

If the engagement member is a rigid securing component such as a rod, it may be rotatably engaged to the patient support by a rotatable engagement means such as a shaft and collar and may also be telescopically adjustable in this configuration. If a strap is employed, the strap is flexible and rotatable to new positions.

In the as-used position, supporting a patient on the side of their body, the engagement member provided by the strap or rigid component generally extends from one side edge of the rigid patient support and over the elevated side of the patient to a distal end. As noted, the distal end may be removably engaged to the bed rail or bed or a component thereof, to maintain the patient on the side of their body using a compressing clamp or hook. In a preferred mode, the engagement member provided by the strap or rigid securing component is adjustable in length to accommodate varying sizes of patients or varying width of beds being employed. The strap would be adjustable using a serpentine path of the strap through buckles and the rigid member would work best being formed in a manner which is telescopic and lockable to the desired length.

In yet another mode, additional support for the rigid support member is provided by an engaged arm member extending from an additional planar support member. When a patient is rolled or otherwise positioned on their side, they are generally positioned closer to one side of the bed, close to a side rail. In use, the additional planar support member of the current mode is braced, supported or otherwise engaged to the opposite side rail such that the arm extends toward the side-positioned patient supporting the rigid support member. In this mode the arm is preferably telescopically adjustable by translational positioning of engaged component members and employs a lock mechanism or other means for fixing the length adjustment known in the art. Further, as noted, it is additionally preferred that the arm member is rotationally engaged to the rigid patient support since the as-used position of the rigid support member may vary patient to patient. It must be noted that the preferred modes of the device may be used separately or in combination with any other of the above disclosed preferred modes.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of the invention to provide a patient support device that is sufficiently rigid to be easily removably engaged between a bed and a prone patient supported thereon in a deployed mode and easily moved by one person to an as-used mode, which maintains a side-resting orientation of a patient within a hospital bed.

It is another object of the invention to provide a flexible strap or rigid support component to maintain the position and orientation of the elongated member support device supporting the patient.

Yet another object of the invention is to provide adjustability in the strap and/or rigid component to accommodate many patient body types and bed types.

Yet a further object of the invention is the reduction of the number of caregivers required to provide hygiene and medical services to patients who are movement-impaired and who require help to roll over when supported by a bed surface and thereby allow valuable medical professionals to server more patients in need.

These together with other objectives and advantages which become subsequently apparent reside in the details of the system for moving and supporting patients in bed and the method herein as more fully hereinafter described and claimed, reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
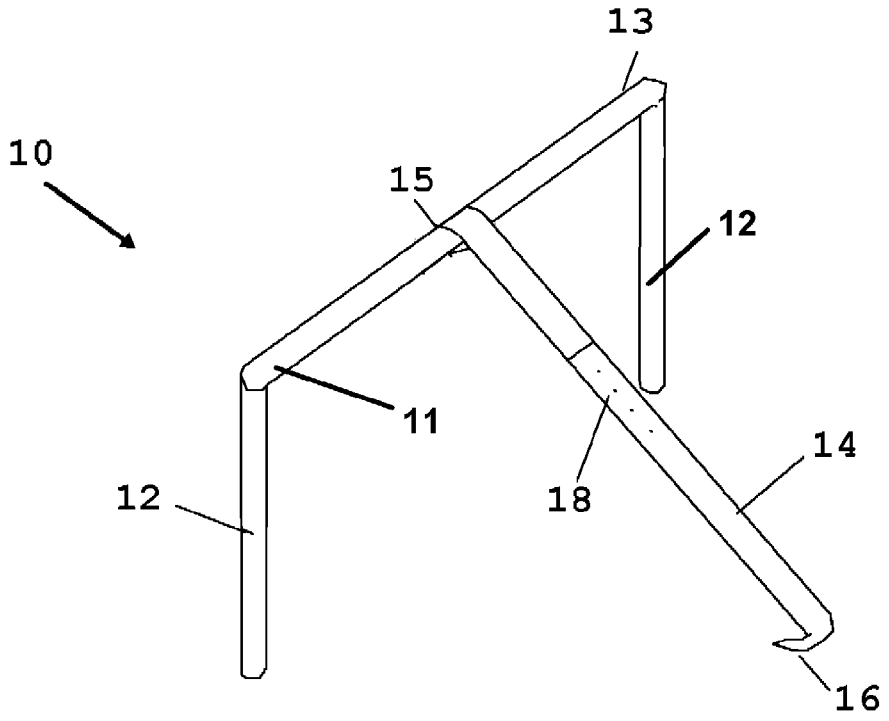
FIG. 1 shows a first preferred mode of the device with the substantially rigid support component defined by two lightweight traverse rod components and a crossbar also employing an adjustable rigid securing component.

Now referring to drawings in FIGS. 1-20 wherein similar components are identified by like reference numerals, there is seen in FIG. 1 a first preferred mode of the device 10. The support frame 11 providing means to hold the patient with one side on the bed and their back vertical to the surface of the bed is defined in this mode by two upright substantially rigid members 12 and a cross member 13. The members 12, 13 forming the support frame 11 are preferably formed from lightweight material such as but not limited to aluminum or polymer plastics. The reduced weight allows for easier maneuverability and management of the device such that the caregiver may easily carry it. Further, the cost is lessened such that each room may be accommodated with a device 10 and lessen the need for transport.

By the term substantially rigid in reference to the frame 11 or planar platform 20 or 22 or other modes of the device 10 herein, is meant that the formed support is sufficiently rigid to be slid between a patient's body and the mattress or bed supporting their body. Such can include metal, polymer, foam, or other materials so long as the formed frame or platform may be pushed on a first edge or slid to a position between the body of the patient and the support surface on which they rest such as the bed. A thin support with slippery contact surfaces would be preferred to allow the user to push on a first side edge which engages with the strap or substantially rigid support member to position the support under the patient and on top of the bed or support surface easily.

A securing means for maintaining the frame 11 or other modes of the support member herein in a vertical disposition adjacent to the back of the patient is also depicted in its first mode in FIG. 1, as a substantially rigid member 14 employing a hook 16 or other means for engagement to the bed rail, at its distal end. As is shown, the proximal end of the securing member when formed of a substantially rigid member 14, is rotatably engaged to the device 10 at the cross member 13 by means of rotatable engagement 15 of the rigid member 14 such as a shaft and collar. It is preferred that the substantially rigid securing component 14 be adjustable in length insofar as to employ a sliding lock mechanism 18 as a means for length adjustment. Those skilled in the art will appreciate various other means for length adjustment and are anticipated.

Figure 2:
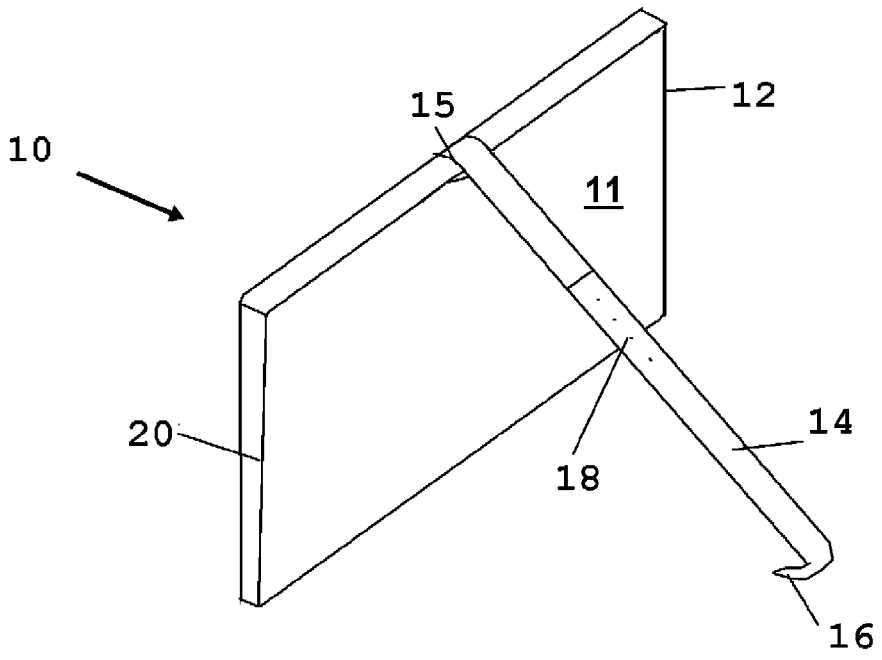
FIG. 2 depicts a second preferred mode of the device with a substantially rigid generally rectangular platform or member sufficiently rigid to be slidably engageable between a patient and supporting bed, an also having a length-adjustable rigid securing component.
Figure 5:
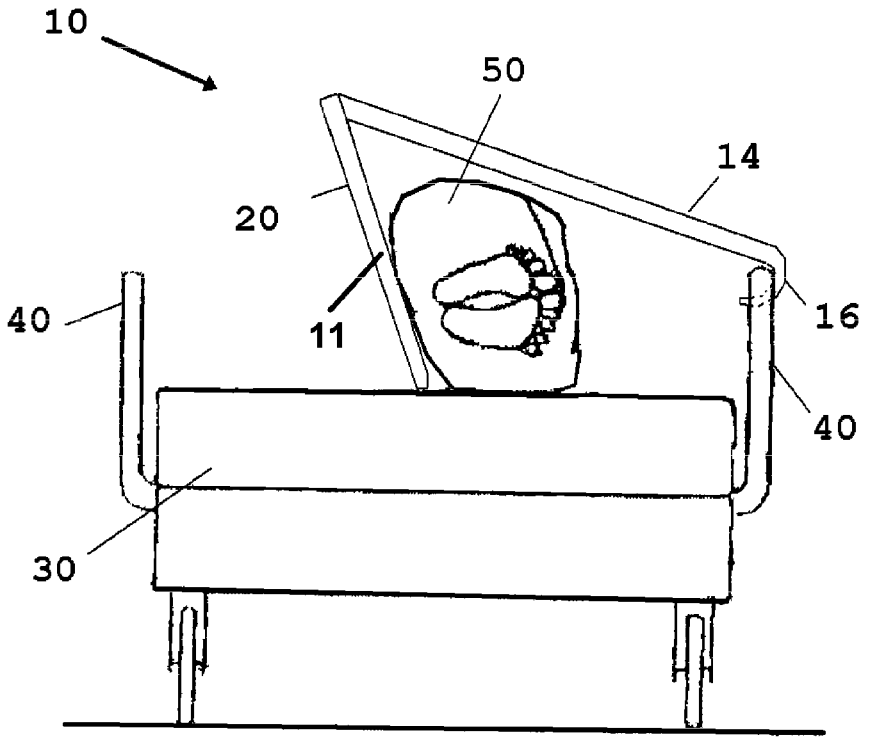
FIG. 5 shows a side view of the as used mode of the device employing a substantially rigid securing component and a hook formed at a distal end as a means for engagement to the bed side rail.
Figure 6:
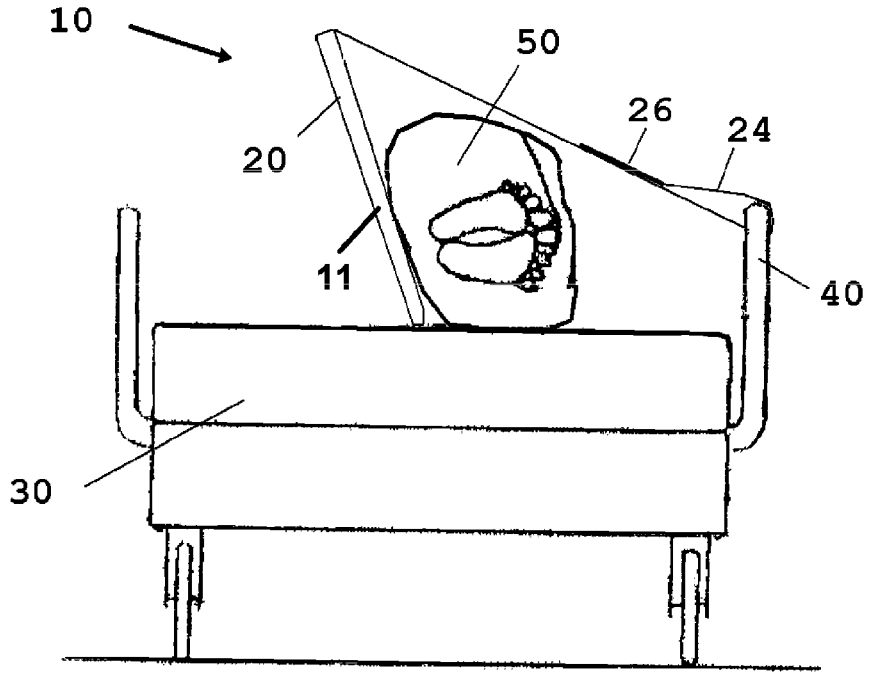
FIG. 6 shows another side view of the as-used mode of the support component device employing a fabric strap securing component and hook and loop type fasteners as means for engagement to the bed side rail and to hold the patient supported on the bed on the side of their body.
Figure 7:
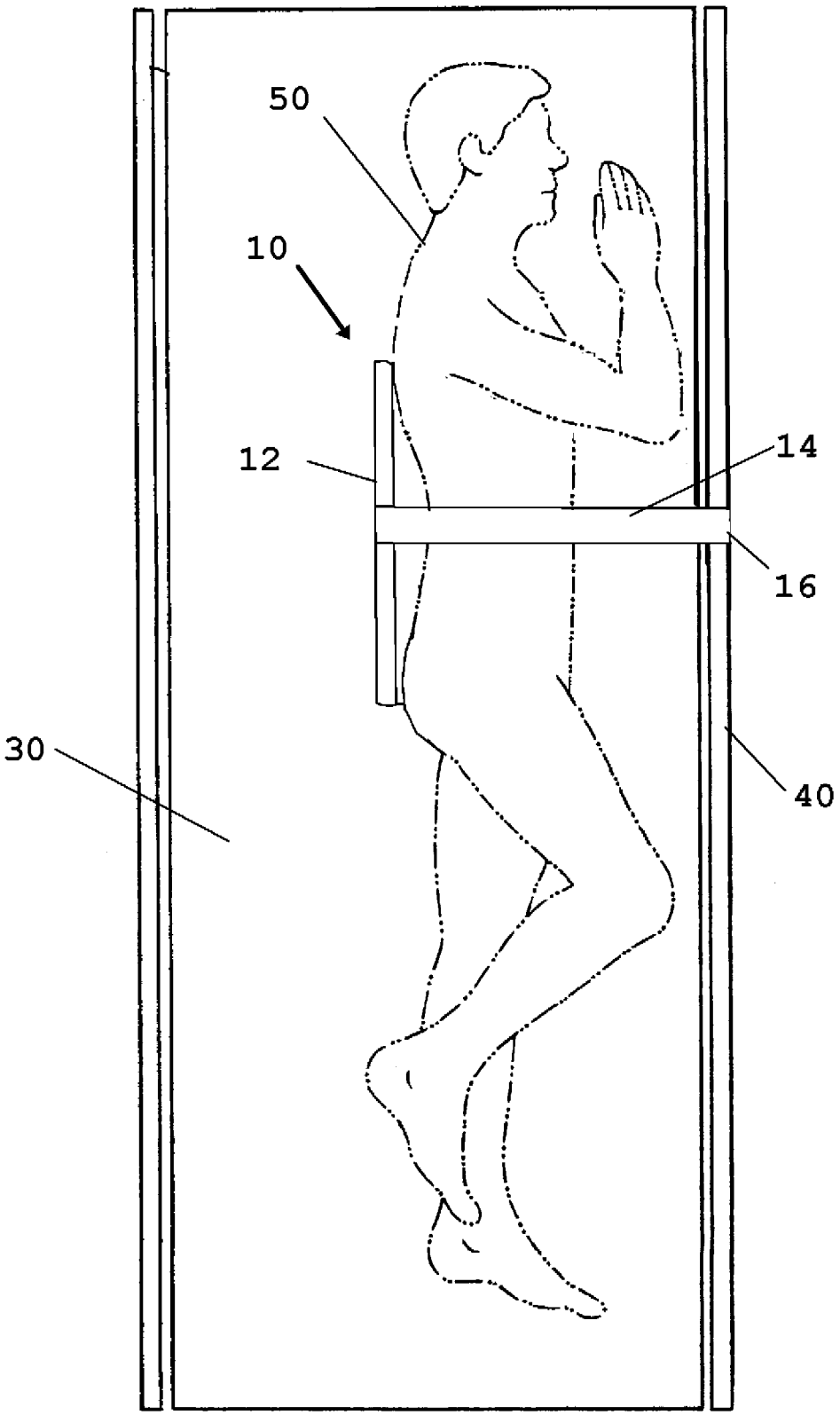
FIG. 7 shows a top view of the as-used mode of the device showing the substantially rigid support component held vertical to maintain the patient on a side of their body.

FIG. 2 shows another preferred mode of the device 10 employing a substantially rigid planar platform component 20 as the support means for the patient. In use, the platform 20 is sized to extend from the shoulders down to the lower back area of the patient providing a larger surface area for support of the patient (FIGS. 5-7). The platform 20 in all modes is also preferably formed of considerably lightweight material such as a lightweight polymer plastic and may be of a hollow or honeycombed interior to minimize weight yet maximize strength to allow it to be pushed or slid into position between the patient and bed or support surface and once rotated, to hold the patient in the side position. The rigid securing component 14 if employed is also engaged to the first or top edge of the substantially rigid platform 20 preferably by a means for rotatably engagement 15. The means for rotatable engagement 15 may be any means known in the art, such as a hinge or the like, while those skilled in the art will appreciate various other means and are anticipated in this disclosure.

Figure 3:
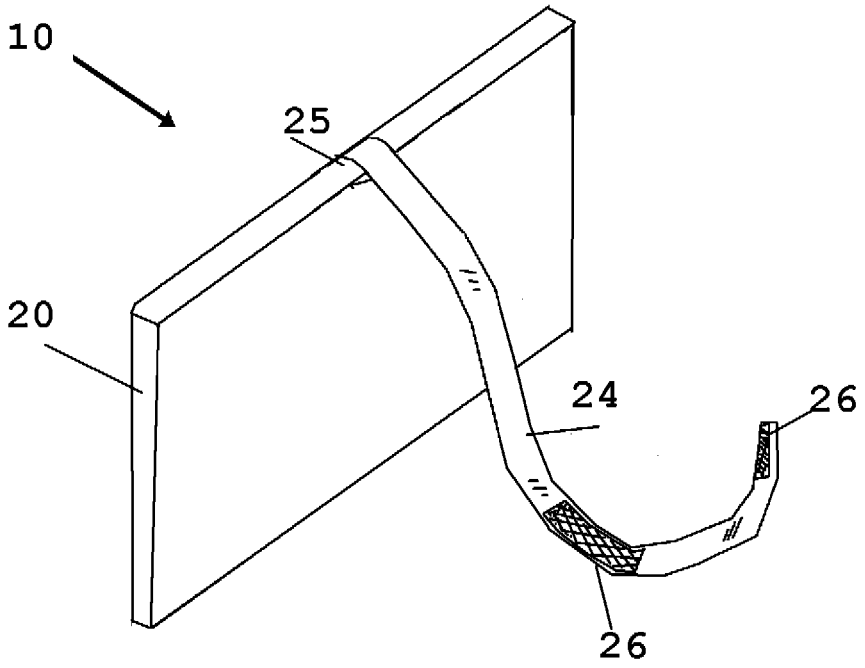
FIG. 3 depicts another preferred mode of the securing component in the form of a fabric strap employing hook and loop type fasteners as one means for engagement to a hospital side rail.

Shown in FIG. 3 is another mode of the securing member depicted as a flexible fabric strap 24 attached to the side of the platform component 20 which may be pushed upon on a first side edge to slide it between the patient and the supporting surface or bed. The strap 24 is of operable length and employs hook and look type fasteners 26 or fasteners of the like at the distal end as a means to engage to the side rail of a hospital bed (see FIG. 5). The proximal end is rotatably engaged to the top edge of the platform component 20 by a means for rotatable engagement 15 such as a sewn loop about a shaft. Again, those skilled in the art will appreciate various other means for rotatable engagement 15 and are anticipated.

The strap 24 may alternatively be rotatably engaged to the cross member 13 of the frame 11 in another mode of the support means previously disclosed, while it is shown on the platform 20 merely for demonstrative purposes. Furthermore, it must be noted that any mode of the securement means may be employed interchangeably with any mode of the support component taught herein to achieve the goals of the current invention and the combinations shown in the depicted figures were chosen merely for demonstrative purposes only and should not be considered limiting.

Figure 4:
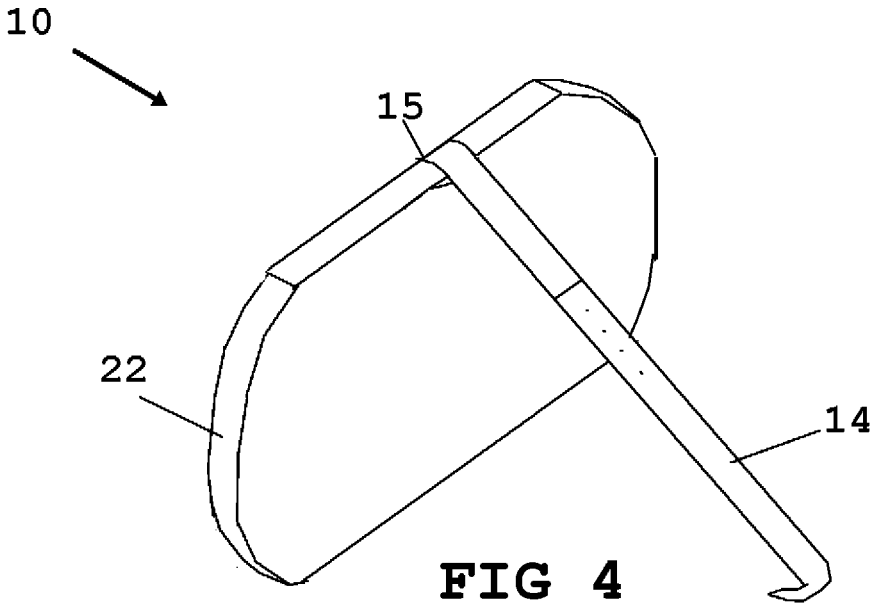
FIG. 4 shows yet another preferred mode of the substantially rigid support component employing an elongated rigid securing component.

Another depiction of the support frame 11 or platform 20 is depicted with curved edges 22 in FIG. 4. This mode may be desired for comfort reasons and the support frame 11 or platform 20 may also take on other shapes (shown or not shown) to better conform to the human body it supports and to be more easily slidable between the patient and bed or support surface.

The as-used position of the device 10 is seen in FIG. 5. The patient 50 is held positioned on their side atop a hospital bed 30. The elongated substantially rigid platform 20 support component is positioned with distal end and hook 16 engaged to the bed 30 at or near the patient's body, such as on the side rail 40. The rigid component 14 extends from the platform 20 to the bed side rail 40 and is engaged via the hook 16 keeping the patient and platform positioned as such.

Further, FIG. 6 shows the as used employment of the strap 24 with the device 10 extending from the first edge of the platform 20 and is engaged to the side rail 40 by an engagement means, such as hook and loop fasteners 26. It is this first edge that may be employed to push the substantially rigid platform 20 or frame or other modes of the device herein, into position between the body of the patient and the bed or support surface.

Once this position is achieved and maintained by the device 10, a nurse or similar medical practitioner may easily proceed to change sheets or clothing as well as perform other tasks that require such position of a patient. Because the platform 20 or frame 11 or other support of the device is positionable between the patient and bed, and then rotatable on a second edge to roll the patient on their side, by a single person, this eliminates the need for two or more caregivers at the same time relieving them to care for others. A top view can be seen in FIG. 7.

Figure 8:
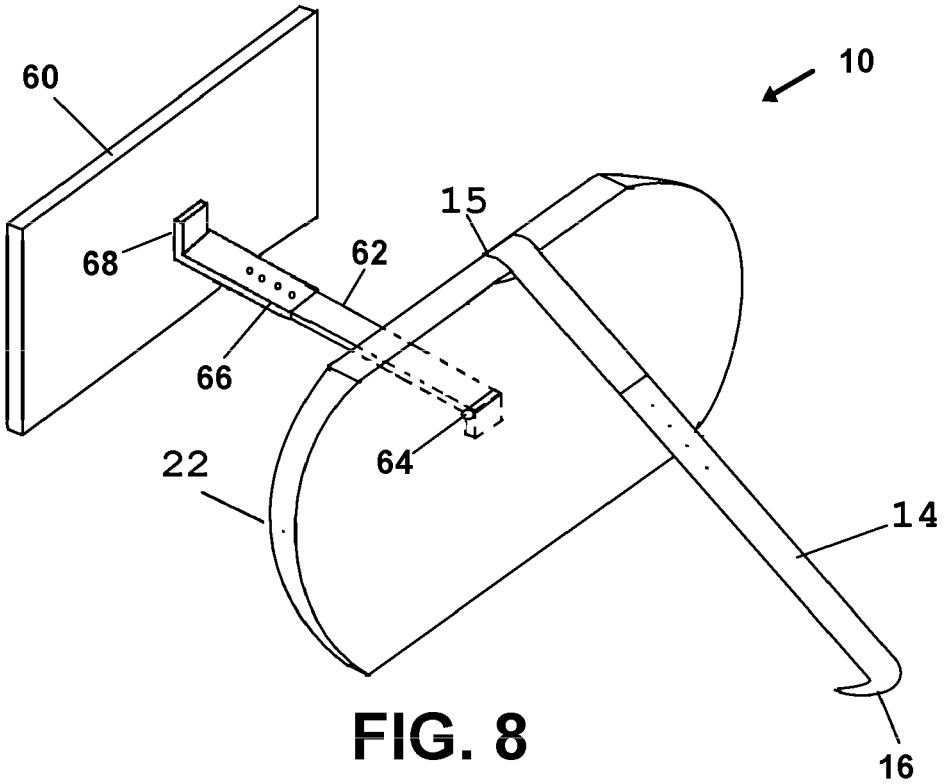
FIG. 8 shows a view of still yet another preferred mode of the device depicting an additional means to support or otherwise secure the rigid support member in the as used position.
Figure 9:
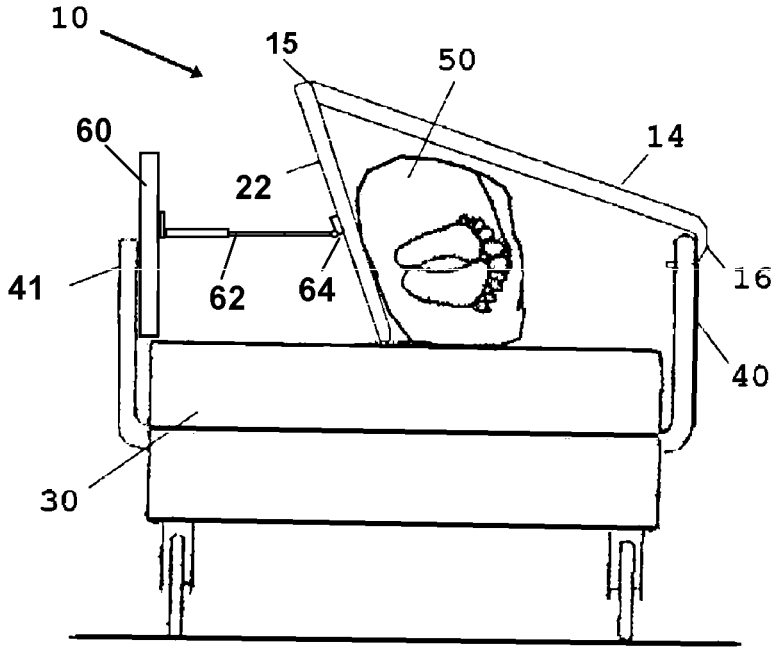
FIG. 9 shows a side view of the as used position of the preferred mode of the device of FIG. 8.

FIG. 8 and FIG. 9 show still yet another preferred mode of the device 10 employing an additional lightweight substantially rigid planar member 60 and arm 62 providing a means to secure or otherwise support the rigid support member 22 in the as used position (see FIG. 9). As is shown the arm member 62 is engage to the planar member 60 via an L-bracket 68 or other engagement means known in the art. The arm 62 extends toward the rigid support member 22 and is engaged via rotational engagement such as a hinged bracket 64. The hinged bracket 64 allows the user to adjust the angular disposition of the rigid support 22 when in the as used mode as may be desired. Further, the arm 62 is preferably adjustable in length such as by employment of a sliding lock mechanism 66 or other means for length adjustability known in the art.

In use, as shown in FIG. 9, where the patient has been rotated, the planar member 60 is braced, supported or otherwise engaged to the opposite side rail 41 with the arm 62 extending toward, and supporting, the rigid support member 22. However, it is within the scope and intent of the present invention that the additional planar member 60 be removed and the arm 62 engaged directly to the side rail 41 may any means should the bed 30 accommodate the device 10 as such.

Figure 10:
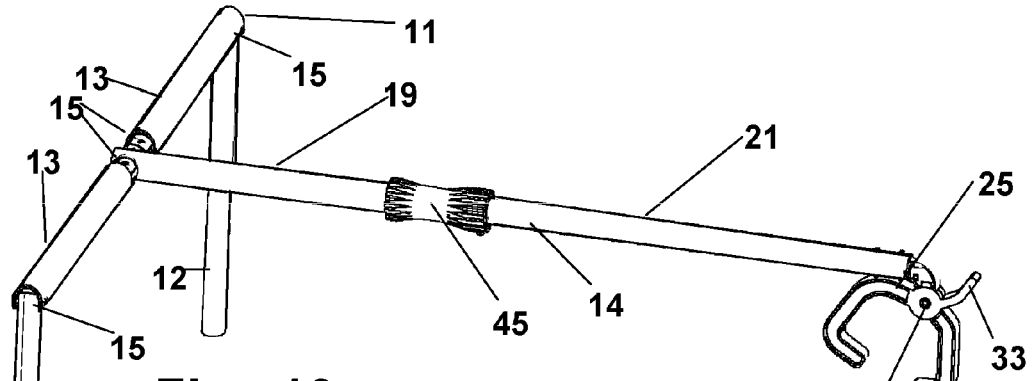
FIG. 10 depicts another favored mode of the support device having a one-hand compressible clip at the distal end of the securing member attached to the support component shown formed by a frame.
Figure 12:
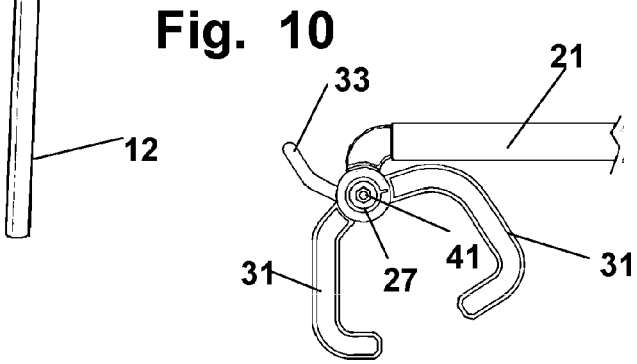
FIG. 12 depicts the compressible clip having opened jaws configured for an encircled or compressed engagement with a bed support or rail and having a release.

In FIG. 10 is depicted a favored mode of the device 10 having a one-hand compressible clip 25 at the distal end of the securing or rigid member 14. The clip 25 employs an internal ratcheting or similar mechanism 27 which operates to tighten and close the jaws 31 toward each other as the handle 33 is pulled to operated the mechanism 27 to rotate the jaws 31 closed.

The ratcheting mechanism 27 is preferably formed to provide mechanical advantage such that rotating the handle 33 with little force exerts a multiple of that force. The gearing for such mechanical advantage will slow the closing of the jaws 31 relative to the movement of the handle 33. Further mechanical advantage is desirable when the clip 25 is engaged in a compressive engagement upon a member 39 as in FIG. 13. The clip 25 is thus especially preferred as a means for removably engaging the distal end of the support member 14 be it the strap 24 or the rigid member 14. This is because the clip 25 opens wide enough as in FIG. 10 to easily traverse a bed frame or rail part and will close in a compressive engagement as in FIG. 13 or an encircled engagement as in FIG. 14. This gives the user more options since in some instances a compressive engagement may be more desirable or easier to achieve and in some cases the encircled engagement.

The clip 25 is operated by one hand moving the handle 33 preferably in a direction toward a pulling user which will operate the internal mechanism 27 to cause a closing of the jaws 31. The mechanism maintains the jaws 31 in the fixed position until a release is activated which releases the force on the jaws 31 which are internally biased to retract to the open position of FIG. 10 upon activation of the release.

Figure 13:
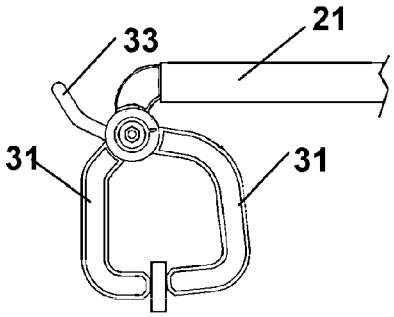
FIG. 13 shows the clip of FIG. 12 having been moved to a closed jaw position wherein the distal ends of the jaws are in a compressive engagement with a bed member therebetween.
Figure 14:
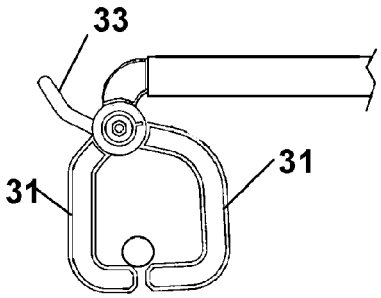
FIG. 14 depicts the clip having been closed by user action such that a rail is encircled and is not releasable without release of the jaws.
Figure 11:
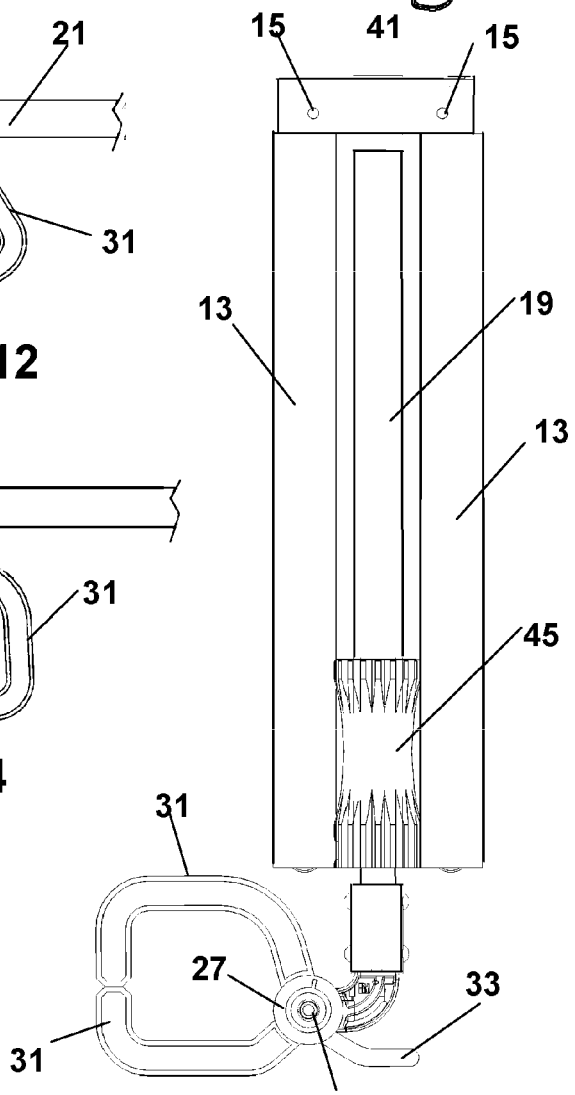
FIG. 11 depicts the device of FIG. 10 showing the folded and compacted position of the device for transport and storage.
Figure 15:
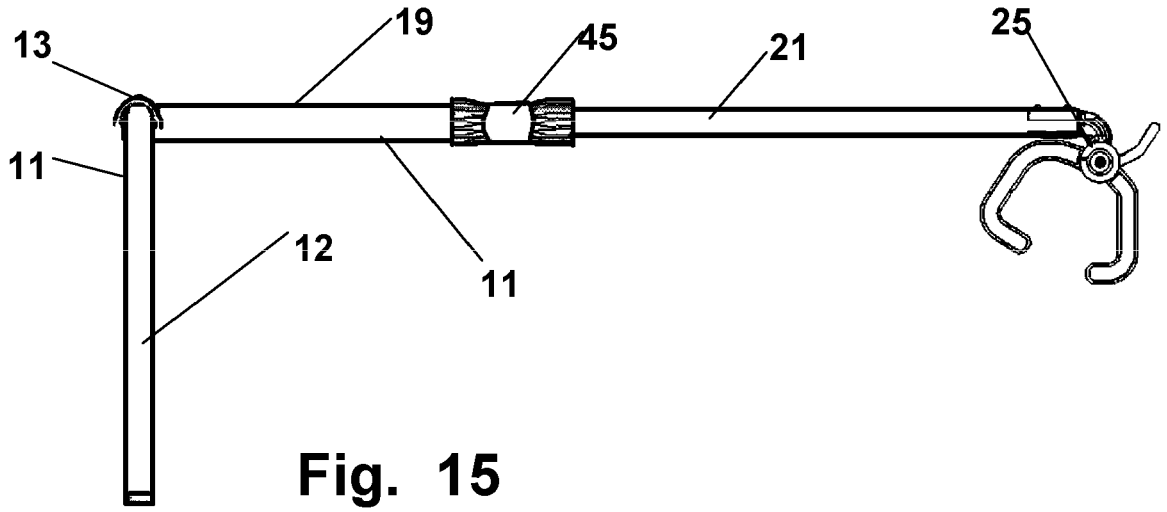
FIG. 15 shows a preferred mode of the device which is foldable to the compact position of FIG. 11 and having a telescopic substantially rigid securing member and having the user compressible clip at a distal end.

The member 14 of the mode of FIGS. 10 and 15 is formed of two telescopically engaged member components 19 and 21, which are held in their relative translated positions to each other by compressive fitting 45. A rotation of fitting 45 in one direction locks the member components 19, 21, and a rotation of the fitting 45 in the opposite direction allows translation telescopically of the member components 19, 21. The upright members 12 are rotationally engaged 15 to the cross member 13 forming the frame 11. The cross member 13 may also be rotationally engaged 15 at two points to member 14 which allows the device 10 of FIGS. 10 and 15 to assume a stored configuration of FIG. 11 which is especially preferred. As noted FIGS. 13-14 are other configurations of the clip 25.

FIG. 15 shows the preferred mode of the device 10 in a side view of the device of FIG. 10 and having the user compressible clip 25 as means for securing the support member 14 to the bed or bed frame located at a distal end.

Figure 16:
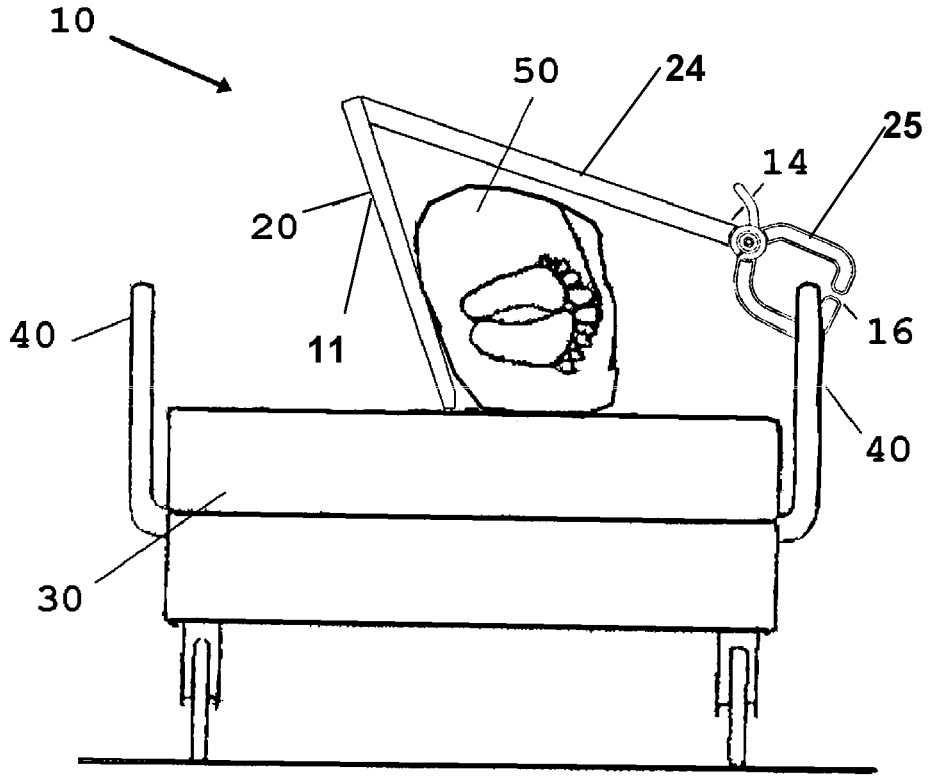
FIG. 16 depicts a mode of the device employing a flexible strap for the securing member and having a compressible clip at the distal end of the strap.

FIG. 16 depicts a mode of the device 10 employing a flexible strap 24 as the securing member and having a compressible clip 25 at the distal end of the strap 24. The strap 24 so engaged to the clip 25 which is attached to the bed frame 40 provides means to hold the support frame 11 substantially upright and to hold the weight of the patient while supporting the patient upright.

Figure 17:
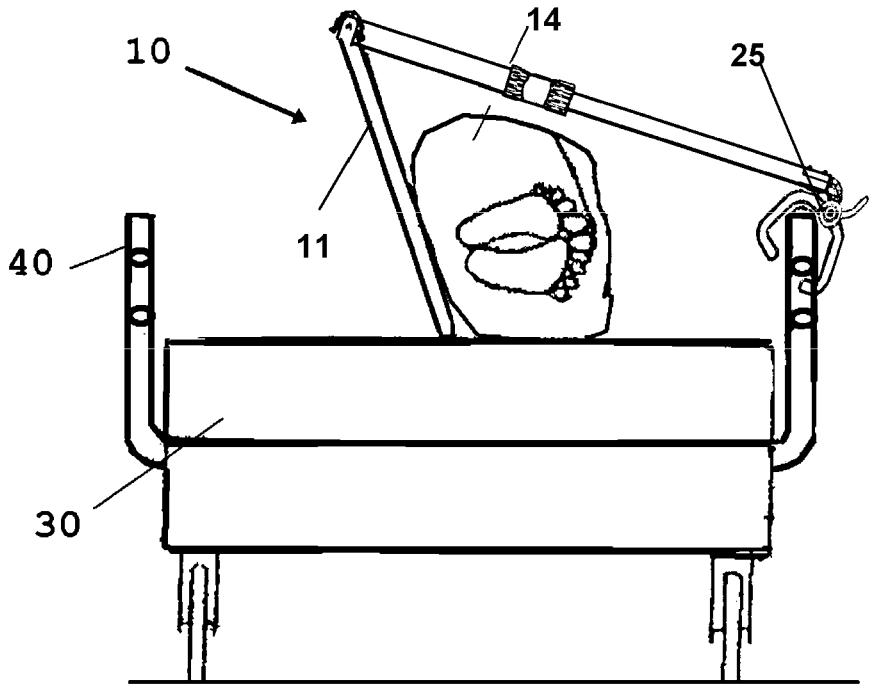
FIG. 17 shows the device in the as-used position having the telescopic substantially rigid securing member engaged to a bed rail through employment of the clamp.

FIG. 17 shows the device 10 in the as-used position having the telescopic substantially rigid securing member 14 engaged to a bed rail 40 through employment of the clamp 25.

Figure 18:
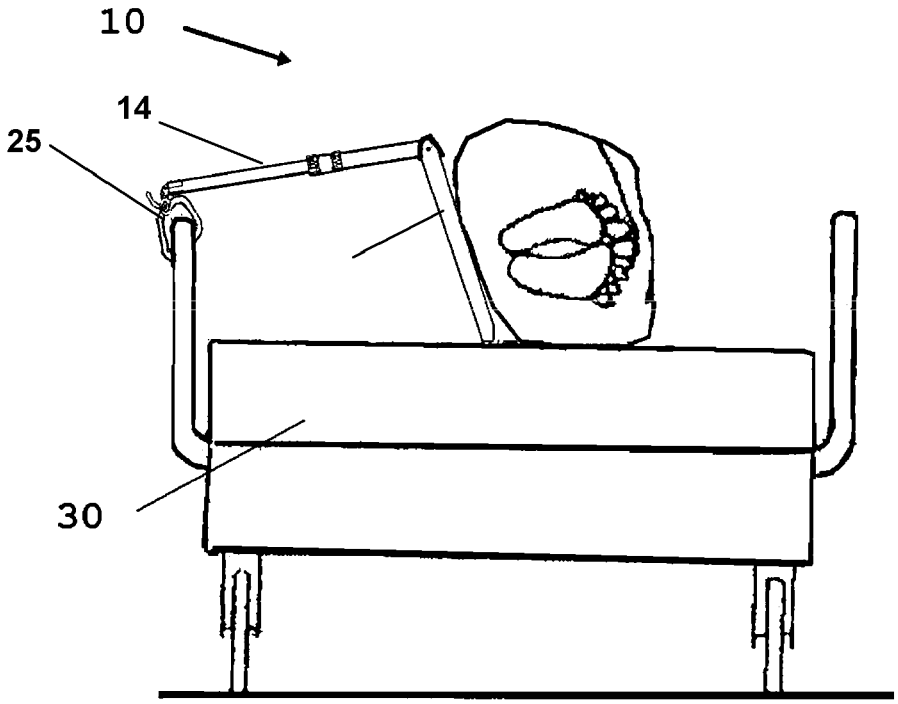
FIG. 18 depicts the device in the as-used position wherein the telescopic securing member is positioned behind the patient's back to maintain the patient supported on their side on the bed surface.

FIG. 18 depicts the device 10 in the as-used position wherein the telescopic securing member 14 is positioned behind the patient's back, and thereby providing means to maintain the frame 11 substantially upright and supporting the downward force of the patient thereon.

It should be further noted that any of the components of the currently disclosed preferred modes of the device 10 may be used separately and in different combinations to achieve the patient support herein taught, such as the combination of either the rigid member 14 or the strap 24 or the clip 25 or the hook 16 as providing the means to maintain the frame 11 or platform 20 upright and supporting the weight of the patient thereon.

Figure 19:
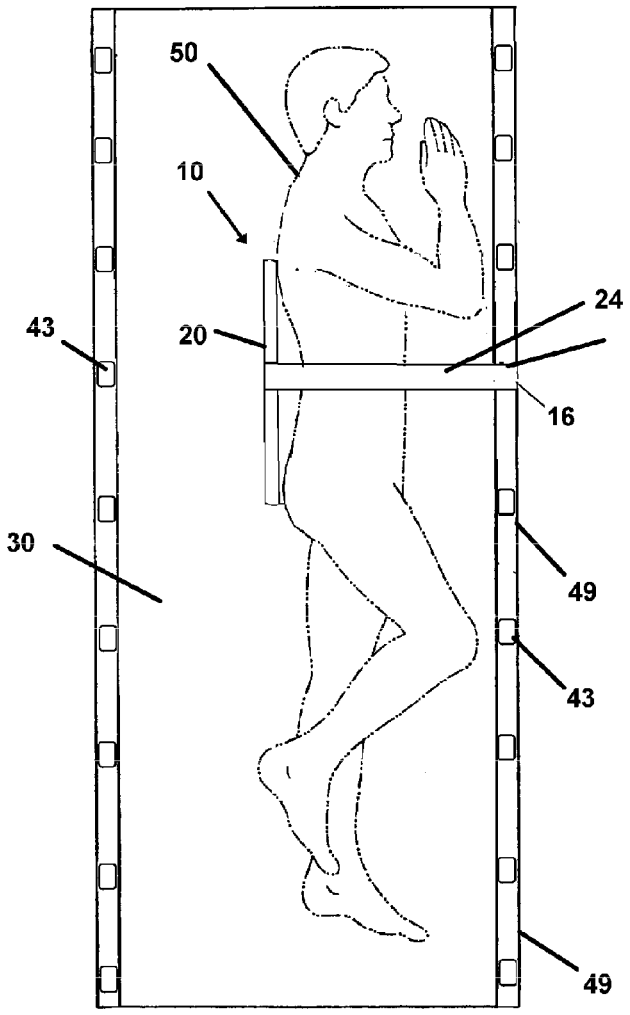
FIG. 19 shows a mode of the device herein wherein the connection to the bed is achieved through a post engageable with one of a plurality of apertures positioned along the side edges of the bed.

As shown in FIG. 19 another favored mode of the device 10 employs a connection to achieve the patient support herein taught, such as at the distal end of a member 14, or strap 24, whereby it is attached to a post 29 configured to engage one of a plurality of apertures 43 formed in the bed frame or rail. A first end of the post 29 is shown engaged with the apertures 43 and a distal or second end of the post 29, can be configured with a mount 47 to engage a clip 25 or the hook 16 on the strap 24, or the distal end of the member 14 if employed, and provide a means to maintain the platform 20 upright in the as-used position supporting the weight of the patient to maintain them on the bed 30 laying on a side of their body.

Figure 20:
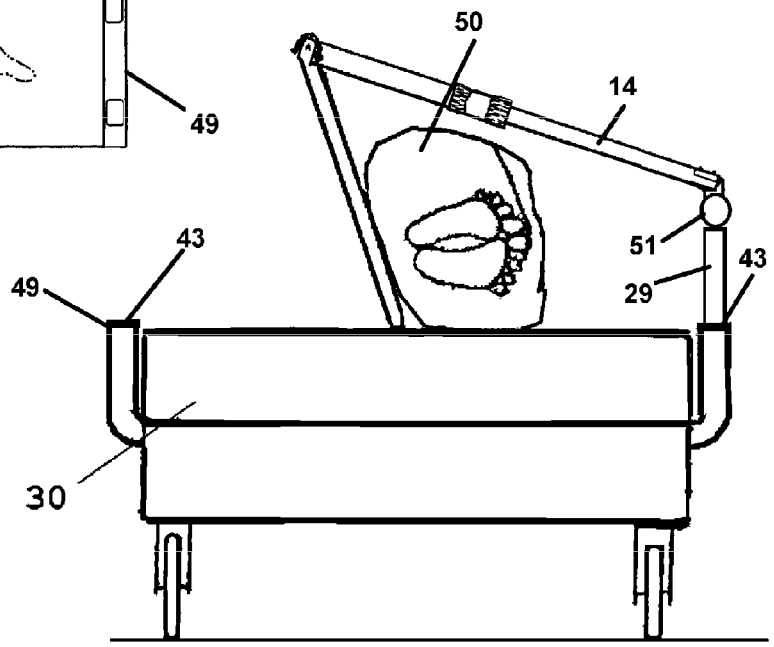
FIG. 20 is an end view of the device as engaged in FIG. 19 wherein the distal end of the belt or a telescopic member, is engaged to a projecting end of a post sized to operatively engage any of the plurality of apertures on the sides of the bed which are conventionally formed on or engaged to the frame.

FIG. 20 is an end view of the device 10 as engaged in FIG. 19 wherein the telescopic member 14 is employed and engaged to the post 29 using a mount 47 which is a rotational pivot 51. In this mode the post 29, pivot 51, and member 14 can be permanently engaged to a platform 20 or a frame 11, to form a single unit which may be moved from bed 30 to bed 30 by simply engaging the post 29 to the desired aperture 43 of each bed 30.

The modes of the device 10 in FIGS. 19 and 20 work especially well with patient beds 30 which are configured with a plurality of apertures 43 formed in a frame 49 of the bed which run along both sides of the bed 30 and engage other medical devices which may be employed in a hospital and patient setting such as uprights for IV's, medical monitoring equipment and the like, and may also be used to engage rails.

Further, while all of the fundamental characteristics and features of the invention have been shown and described herein, with reference to particular modes thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. An apparatus for maintaining a patient laying in a bed in a position where said patient is supported on said bed by a side surface of their body in contact with said bed, comprising;

a substantially rigid planar support member, said support member slidably positionable to a first position between a patient and bed supporting said patient by an exertion of force against a first edge thereof;

said support member positionable from said first position to an as-used position upright and having a second edge thereof, opposite said first edge, in a contact with a surface of said bed;

a central portion of said support member between said second edge and said first edge, in said as-used position, configured for a contact with a portion of a back of said patient; and a flexible strap, said flexible strap being adjustable in length thereby providing means for adjusting an angle of said central portion of said support member relative to said surface of said bed, along a line running from said second edge through said first edge a flexible strap extending a length between a first end engaged with said support member and a second end adapted for a releasable engagement with one of a frame or handrail of said bed, said flexible strap communicating a force of a weight of said patient against said support member, to said frame or said handrail of said bed, said flexible strap being adjustable in said length to thereby provide means for adjusting an angle of said central portion of said support member relative to said surface of said bed, along a line running from said second edge through said first edge, whereby said strap maintains said support member in said as-used position.

2. The apparatus of claim 1 wherein said releasable engagement to said frame or bed comprises:

a clip engageable to one of a mount on said handrail or a said mount engaged to said frame.

3. The apparatus of claim 2 wherein said releasable engagement to said frame or bed additionally comprises:

a post engageable at a first end to an aperture in said frame; and said post having said mount positioned on a second end, opposite said first end thereof.

4. The apparatus of claim 1 wherein said support member comprises:

a cross member having first and second ends;

a pair of secondary members extending from engagements to said cross member at said first and second ends to respective distal ends;

said cross member defining said first edge; and said distal ends of said secondary members defining said second edge.

5. An apparatus for maintaining a patient laying in a bed in a position where said patient is supported on said bed by a side surface of their body in contact with said bed, comprising;

a substantially rigid planar support member, said support member slidably positionable to a first position between a patient and bed supporting said patient by an exertion of force against a first edge thereof;

said support member positionable from said first position to an as-used position upright and having a second edge thereof, opposite said first edge, in a contact with a surface of said bed;

a central portion of said support member between said second edge and said first edge, in said as-used position, configured for a contact with a portion of a back of said patient; and a substantially rigid securing member engaged at a first end to said support member and having a clip at a second end configured for a releasable engagement to one of a mount on said hand rail, or a mount engaged to said frame, whereby a weight of said patient against said support member is communicable by said securing member in said engagement to one of said frame or handrail of said bed, while maintaining said support member in said as-used position.

6. The apparatus of claim 5 wherein said releasable engagement to said frame or bed additionally comprises:

a post engageable at a first end to an aperture in said frame; and said post having said mount positioned on a second end, opposite said first end thereof.

7. The apparatus of claim 5 additionally comprising:

said substantially rigid supporting member being telescopically adjustable for a length thereof.

8. The apparatus of claim 7 additionally comprising:

said mount positioned on a second end of said post being a pivot connecting said post to said supporting member.

9. The apparatus of claim 5 additionally comprising:

said clip having opposable jaws; and ratcheting means to move said jaws from an open position with distal ends of said jaws forming a gap therebetween, to a closed position wherein said gap is smaller than a cross section of a portion of said frame or bed said jaws surround.

10. The apparatus of claim 5 wherein said support member comprises:

a cross member having first and second ends;

a pair of secondary members extending from engagements to said cross member at said first and second ends to respective distal ends;

said cross member defining said first edge; and said distal ends of said secondary members defining said second edge.

* * * * *